United States Patent [19]

Pyle

[11] Patent Number: 4,801,165

[45] Date of Patent: Jan. 31, 1989

[54] HOOD LATCH

[75] Inventor: Jeffrey A. Pyle, Hannibal, Mo.

[73] Assignee: Buckhorn Rubber Products, Inc., Hannibal, Mo.

[21] Appl. No.: 73,825

[22] Filed: Jul. 15, 1987

[51] Int. Cl.[4] ..... E05C 19/10

[52] U.S. Cl. ..... 292/249; 292/DIG. 38; 292/DIG. 14; 292/DIG. 49

[58] Field of Search ..... 292/80, 87, 91, 101, 292/109, 114, 128, 129, 213, 246, 247, 249, DIG. 14, DIG. 38, DIG. 49

[56] References Cited

U.S. PATENT DOCUMENTS

| | | | |
|---|---|---|---|
| 1,007,398 | 10/1911 | Snider | 292/129 |
| 1,400,953 | 12/1921 | Hennicke | 292/247 |
| 3,881,758 | 5/1975 | Gross | 292/DIG. 38 |
| 3,892,434 | 7/1975 | Caldwell | 292/247 |
| 3,985,380 | 10/1976 | Raivio | 292/DIG. 38 X |
| 4,270,668 | 6/1981 | Berfield | 292/87 X |
| 4,665,596 | 5/1987 | Green | 292/DIG. 38 |

*Primary Examiner*—Richard E. Moore
*Attorney, Agent, or Firm*—Senniger, Powers, Leavitt and Roedel

[57] ABSTRACT

A latch for releaseably securing one body portion, such as a hood, to another body portion, such as a cowl, of a semi-tractor or the like. One of the body portions has a hook member mounted thereon and the other carrys a securing device. The latch is of one-piece molded construction comprising an elongate elastomeric member having a handle at one end, an opening therein adjacent the handle and a tongue in the opening extending from the handle toward the other end, the handle and tongue being integral with the elongate member. The free end of the tongue is adapted for engaging the hook member, and an opening is provided at the other end of the elongate member for connection to the securing device. The free end of the tongue is spaced from the opening a distance less than the distance the hook member is spaced from the securing device when the two body portions are adjacent one another and the elongate member is untensioned. The tongue of the elongate member is adapted to be brought overcenter with respect to the plane of the elongate member when the handle is pushed toward the body portion on which the hook means is mounted while the tongue is engaging the hook means thereby tensioning the elongate member and securing together the two body members.

19 Claims, 2 Drawing Sheets

HOOD LATCH

BACKGROUND OF THE INVENTION

This invention relates generally to latches, and more particularly to a latch for releasably securing one body portion, such as a hood, to another body portion, such as a cowl, of a truck-tractor.

Heretofore, truck- or semi-tractor hoods have been secured to the cowl or fender of the tractor by any of a variety of latches. In one type of latch, a spring-loaded piston is movable inside a metal cylindric member mounted on one body portion of the truck-tractor, the piston being movable outwardly with respect to the cylindric member against the bias of a spring. A metal hook member is connected to a metal U-shaped structure or yoke extending outwardly from the piston, the hook member being pivotable with respect to the yoke to hook or latch onto a hook on the other body portion and pull the piston outwardly with respect to the cylindric member, thereby securing the hook and cowl together. However, this type of latch is expensive to manufacture and assemble because of the complexity of the design and the close tolerances required for the moving parts. In addition, since the latch is constructed from metal, it may chip the painted surfaces of the truck-tractor in normal use.

Another type of latch comprises an elastomeric strap formed or molded with a lateral bore at one end for securing the end to one body portion of the truck-tractor and with a spherical or ball structure adjacent the other (free) end. The free end of the strap is pulled away from the secured end to stretch the strap until the spherical structure can be placed in a cup on the other body portion, thereby securing the two body portions together. Problems with this design include the difficulty of stretching the strap sufficiently to place the spherical structure in the cup and the tendency of the spherical structure to "pop" out of the cup, thereby releasing the latch.

Another example is an overcenter latch comprising an elastomeric strap having a lateral bore at one end and a pivotable metal plate or handle at the other end. One end of the plate may be placed in a hook member on, for example, the cowl by pivoting the plate on the strap. The other (free) end of the plate is then pressed toward the cowl until the strap is brought inwardly (toward the cowl) past the "hooked" end of the plate, thereby securing the hood to the cowl. The latch can only be released by pulling the free end of the plate away from the cowl, and the elastomeric strap tends to resist this since it is stretched by the plate as the plate is pulled from the cowl. While this overcenter latch is generally effective in securing the body portions together, it is relatively expensive and mechanical assembly of the plate and strap is required. In addition to increasing manufacturing cost, the metal plate will typically bounce against the painted surface of the cowl, for example, as the hood is being latched and released thereby chipping the paint from the cowl.

SUMMARY OF THE INVENTION

Among the several objects of the invention may be noted the provision of a latch for releasably securing a first body portion, such as a hood, to a second body portion, such as a fender, of a semi-tractor; the provision of such a latch which is of uncomplicated design and of one-piece construction; the provision of such a latch which is formed of materials which are unlikely to scratch or chip the paint on either body portion; the provision of such a latch which is durable and reliable in operation; the provision of such a latch which is economical to manufacture; and the provision of such a latch which is not prone to accidental release of the body portions.

Generally, a latch of the present invention s adapted for releasably securing one body portion, such as a hood, to another body portion, such as a cowl, of a semi-tractor or the like. One of the body portions has hook means mounted thereon and the other carries securing means. The latch is of one-piece molded construction comprising an elongate elastomeric member having a handle at one end, an opening therein adjacent the handle and a tongue in the opening extending from the handle toward the other end. Connecting means are provided on the other end of the elongate member for connection to the securing means. The handle and tongue are integral with the elongate member, and the free end of the tongue is adapted for engaging the hook means. The free end of the tongue is spaced from the connecting means a distance less than the distance the hook means is spaced from the securing means when the two body portions are adjacent one another and the elongate member is untensioned. .The tongue of the elongate member is adapted to be brought overcenter with respect to the plane of the elongate member when the handle is pushed toward the body portion on which the hook means is mounted while the tongue is engaging the hook means thereby tensioning the elongate member and securing together the two body portions.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
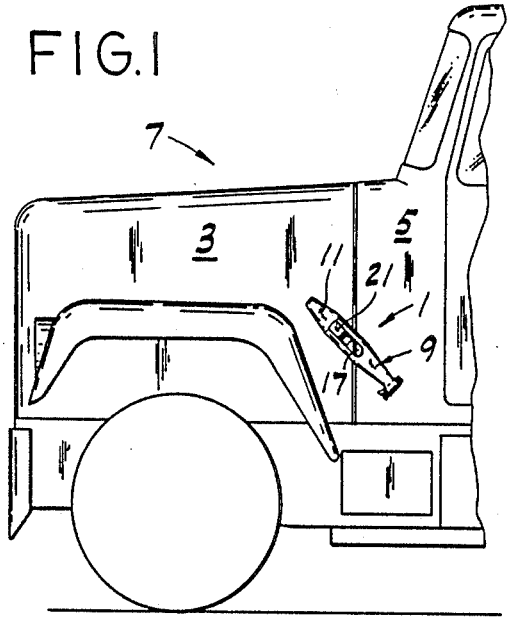
FIG. 1 is a partial side elevation of a semitractor on which a latch of the present invention is being used.
Figure 2:
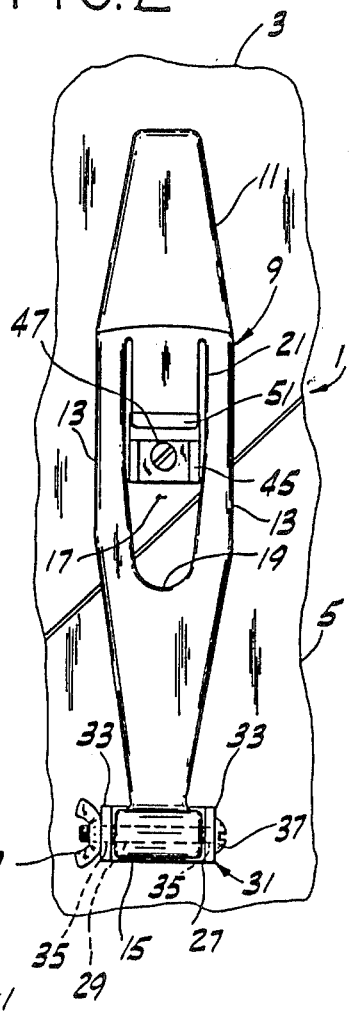
FIG. 2 is a front view of the latch of FIG. 1.

Referring now to the drawings, a latch of the present invention is designated in its entirety by the reference numeral 1. As shown in FIG. 1, the latch 1 is especially adapted for releasably securing one body portion, such as a hood 3, to another body portion, such as a cowl 5, of a truck-tractor 7 or the like, although it will be understood that the latch may have other uses.

The latch 1 comprises an elongate elastomeric member generally designated 9 having a handle 11 at one (upper) end, and elongate elastomeric side portions 13 extending from the handle toward the lower end 15 of the elastomeric member 9. The side portions 13 define an elongate opening 17 in the elastomeric member 9 extending from adjacent the handle and terminating in a rounded end 19 between the handle and the lower end 15 of the elastomeric member. The opening 17 may extend from the handle, for example, approximately halfway to the lower end 15 of the elastomeric member 9. A tongue 21 is provided in the opening 17 extending from the handle 11 between the side portions 13 toward the rounded end 19 of the opening and the lower end 15 of the elastomeric member 9. The side portions 13 of the elastomeric member 9 are spaced apart a distance sufficient to allow the tongue 21 to move inwardly (i.e., right in FIG. 3) and outwardly (i.e., left in FIG. 3) through the opening 17 of the elastomeric member 9. The elastomeric member 9 is tapered toward its lower end 15 between the rounded end 19 of the opening 17 and the lower end. An anti-rattle knob 23 may be provided on the tapered portion of the elastomeric member 9 to tension the member against the surface of the truck-tractor 7.

Preferably, the latch 1 is of one-piece molded construction, and the handle 11 and tongue 21 are integral with the elongate member 9. As used herein, "integral" and "one-piece construction" mean formed of or molded in one contiguous or continuous piece. Elements of a construction are not "integral" with one another if they are mechanically fastened together. For example, the elongate member 9 may be "integrally" molded of a synthetic rubber, such as EPDM rubber, with an internal reinforcing core 25 of plastic or synthetic resin material positioned in the handle 11 and tongue 21. Where the handle 11 and tongue 21 include an optional internal reinforcing core 25, the synthetic rubber preferably has a hardness of approximately 60 durometer on the Shore A scale. It will be understood that the internal core 25 may be omitted by increasing the hardness of the rubber material (e.g., to 80 durometer on the Shore A scale) to compensate, at least partially, for its absence.

A transverse cylindric portion 27 is formed at the lower end 15 of the elastomeric member, the longitudinal axis of the cylindric portion and the longitudinal axis of the elastomeric member being generally coplanar and perpendicular. The cylindric portion 27 includes a bore or opening 29, constituting connecting means, coaxial with the cylindric portion for connecting the elongate member to the cowl 5 of the semi-tractor 7.

Securing means comprising a generally U-shaped bracket generally designated 31 of synthetic resin material is mounted or carried on the cowl 5 of the semi-tractor. Each arm 33 of the U-shaped bracket 31 has an opening or hole 35, the holes being co-axial and equally spaced from the cowl 5 of the truck-tractor 7. A pivot pin or screw 37 placed in the bracket holes 35 and internal bore 29 secures the elongate member 9 to the U-shaped bracket 31 while allowing the elongate member to pivot with respect to the bracket, and a wing-nut 39 secures the screw to the bracket. The U-shaped bracket 31 is preferably rotatable with respect to an axis perpendicular to the surface of the cowl 5, as may be the case when the bracket is secured to the hood by a single bolt or screw 41.

The tongue 21 of the elongate member 9 is formed with a rounded free end 43 adapted to engage hook means comprising a hook member 45 mounted (e.g., by screws 47) on the hood 3 to secure the elongate member to the hood. The rounded free end 43 of the tongue 9 is preferably formed by a protruding portion or nose 43 of the internal core 25 because the wear resistance of the synthetic resin core is generally greater than that of elastomeric material. The hook member 45 is formed of similar plastic or synthetic resin material with a rounded hook portion 51 complementary to the rounded free end 43 of the tongue 21 for removably receiving and holding the free end of the tongue. The rounded hook portion 51 is spaced a distance from a base 53 of the hook member 45 and/or the hood 3 greater than the distance the pivot screw 37 and holes 35 of the U-shaped bracket 31 are spaced from the cowl 5. It will be understood that the side portions 13 of the elongate member 9 are spaced apart a distance sufficient to allow the hook member 45 to pass through the elongate opening 17.

Figure 3:
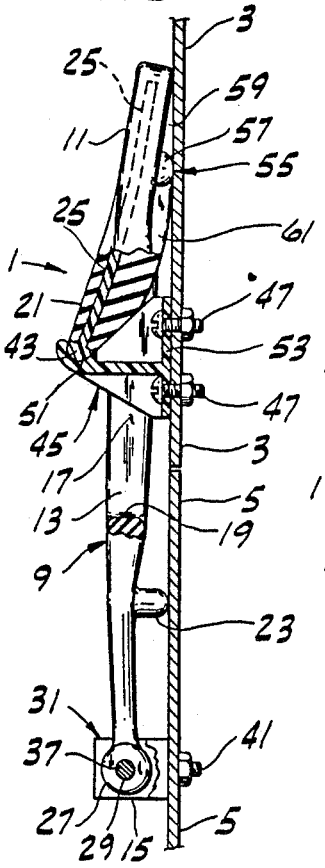
FIG. 3 is a side elevation of the latch of FIGS. 1 and 2 with portions broken away to illustrate details.
Figure 4:
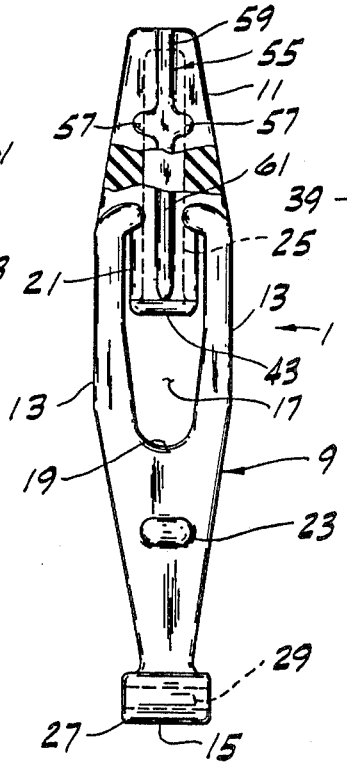
FIG. 4 is a rear view of the latch of FIGS. 1–3.

As shown in FIGS. 3 and 4, a reinforcing ridge 55 is formed and integrally molded with the handle 11 and tongue 21 on the surface of the handle and tongue opposing the hood 3, the ridge being adapted to press against the hood when the tongue is brought overcenter with respect to the elongate member. For example, the reinforcing ridge 55 may be generally cruciform-shaped as shown in FIG. 4 with transversely extending cross portions 57 and upper and lower longitudinally extending portions 59 and 61. Preferably, the upper longitudinally extending portion 59 tapers down to the surface of the handle 11 in the direction away from the cross portions 57 so that the upper portion and the cross portions press against the hood when the tongue 21 is brought overcenter.

The free end 43 of the tongue 21 is spaced from the internal bore 29 of the cylindric portion 27 of the elastomeric member 9 a distance less (e.g., 10–15 percent less) than the distance the hook member 45 is spaced from the securing bracket 31 when the hood 3 and cowl 5 are adjacent one another and the elongate member is untensioned. In addition, the free end 43 of the tongue 21 is easily movable out of the plane of the elastomeric member 9 so that it can be placed in the hook portion 51 of the hook member 45 with little or no stretching or tensioning of the elastomeric member by bending the handle 11 and tongue out of the plane of the member.

Figure 5:
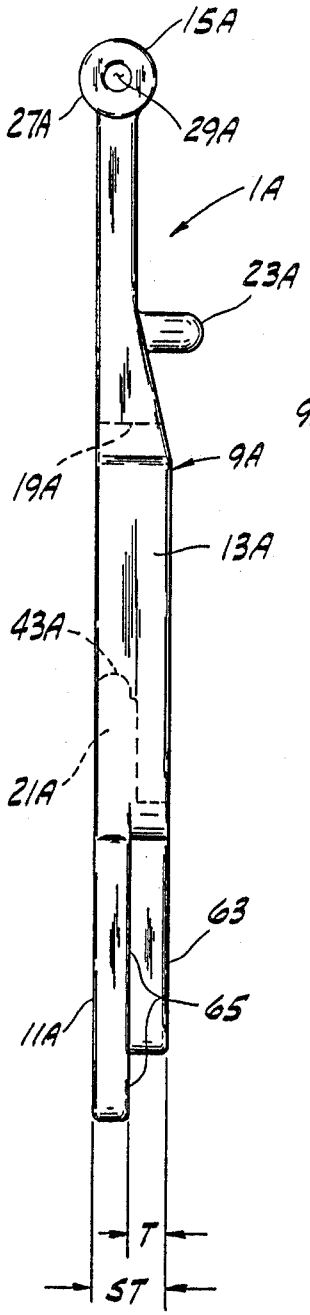
FIG. 5 is a side elevation of another embodiment of a latch of the present invention.
Figure 6:
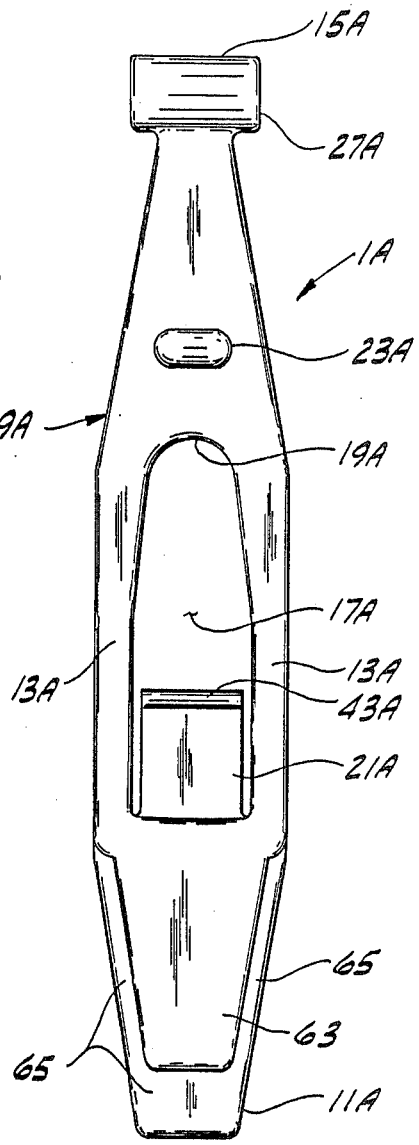
FIG. 6 is a rear view of the latch of FIG. 5.

FIGS. 5 and 6 illustrate another embodiment of the invention generally corresponding to the embodiment of FIGS. 1–4 with the difference being that the elongate member, here designated 9A, has a generally trapezoidal reinforcing ridge 63 on the rear or under side of the handle 11A. The thickness T (FIG. 5) of the reinforcing ridge 63 is sufficiently great that a ledge 65 for gripping the handle 11A is formed on the rear side of the handle along the sides of the reinforcing rib. The thickness ST of the side portions 13A of the elongate member 9A is preferably substantially equal to the combined thickness of the reinforcing ridge 63 and handle 11A, the side portions and reinforcing ridge forming a contiguous, reinforcing structure on the elongate member. The side portions 13A of the elongate member 9A are tapered down adjacent the lower, rounded end 19A of the opening toward the lower end 15A of the elongate member.

When the free end 43 (43A) of the tongue 21 (21A) is placed in the hook portion 51 of the hook member 45 and the handle 11 (11A) is pushed toward the hook 3 of the truck tractor 7, the elastomeric member 9 (9A) is stretched or tensioned between the securing bracket 31 and the hook member. the maximum tension or stretch of the elastomeric member 9 (9A) occurs as the handle 11 (11A) is being pushed toward the hood 3 when the tongue 21 (21A) is in the plane of the elastomeric member and the side portions 13 (13A) of the elongate member are adjacent the hook portion 51 of the hook member 45. If the handle 11 (11A) is pushed slightly inwardly (toward the hood 3) from the plane of the elastomeric member 9 (9A), the tension of the elastomeric member will tend to pull the handle against the surface of the hood (i.e., to the overcenter position), thereby securing the hood to the cowl. In the overcenter position, the tongue 21 (21A) is pivoted outwardly (left in FIG. 3) relative to the side portions 13 (13A) of the elastomeric member. From this overcenter position, the handle 11 (11A) may only be pulled from the hood 3 by stretching or tensioning the elongate member 9 (9A) more than it is stretched in the overcenter position. This substantially reduces the possibility of latch 1 or 1A being released accidentally, for example, when the truck-tractor 7 hits a large pothole.

It will be understood that, while the hook member 45 may be attached to the cowl 5 and the securing bracket 31 may be attached to the hood 3 instead of vice versa, by attaching the hook member to the hood, the hood may be raised without pulling the elastomeric member 9 or 9A upwardly. This is advantageous since otherwise the elastomeric member 9 or 9A may possibly snag various parts of the truck-tractor 7 as the hood 3 is raised.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A latch for releasably securing one body portion, such as a hood, to another body portion, such as a cowl, of a semi-tractor or the like, one of said body portions having hook means mounted thereon and the other carrying securing means, the latch being of one-piece molded construction and comprising an elongate elastomeric member having a handle at one end, an opening therein adjacent the handle and a tongue in the opening extending from the handle toward the other end, the handle and tongue being integral with the elongate member and having a stiffness substantially greater than that of the balance of the latch, the free end of the tongue being adapted for engaging the hook means and connecting means on the other end of the elongate member for connection to said securing means, the free end of the tongue being spaced from said connecting means a distance less than the distance said hook means is spaced from said securing means when the two body portions are adjacent one another and the elongate member is untensioned, the tongue of the elongate member being adapted to be brought overcenter with respect to the plane of the elongate member when the handle is pushed toward the body portion on which the hook means is mounted while the tongue is engaging said hook means thereby tensioning the elongate member and securing together the two body portions.

2. A latch as set forth in claim 1 wherein the elongate member includes elongate side portions extending from the handle toward said connecting means, the side portions defining the opening in the elongate member and being substantially more flexible and resilient than the handle and tongue.

3. A latch as set forth in claim 2 wherein the opening in the elongate member is generally elongate.

4. A latch as set forth in claim 2 wherein the side portions of the elongate member are spaced apart a distance sufficient to allow said hook means to pass through the opening.

5. A latch as set forth in claim 1 wherein the handle and tongue have an internal reinforcing core.

6. A latch as set forth in claim 5 wherein the tongue of the elongate member has a rounded free end adapted to engage said hook means, the rounded free end of the tongue being formed by a protruding portion of the internal core.

7. A latch as set forth in claim 5 wherein the elastomeric material from which the elongate member is molded is a synthetic rubber having a hardness of approximately 60 durometer on the Shore A scale.

8. A latch as set forth in claim 7 wherein the core comprises a relatively stiff and inflexible material with a hardness substantially greater than that of the material from which said elongate elastomeric member is formed.

9. A latch as set forth in claim 1 wherein the elongate member has a reinforcing ridge formed on the surface of the handle and tongue opposing the body portion on which the hook means is mounted, the ridge being adapted to press against the last said body portion when the tongue is brought overcenter with respect to the elongate member.

10. A latch as set forth in claim 9 wherein the ridge is integrally molded with the handle and tongue.

11. A latch as set forth in claim 1 wherein the elongate member is pivotable with respect to an axis through said securing means parallel to the surface of the body portion on which the securing means is carried.

12. A latch assembly for releasably securing together one body portion, such as a hood, to another body portion, such as a cowl, of a semi-tractor or the like; comprising securing means adapted to be mounted on one of the portions, and hook means adapted to be carried on the other body portion and a latch of onepiece molded construction comprising an elongate elastomeric member having a relatively stiff handle at one end, an opening therein adjacent the handle and a relatively stiff tongue in the opening extending from the handle toward the other end, the handle and tongue being integral with the elongate member and having a stiffness substantially greater than that of the balance of the latch, the free end of the tongue being adapted for engaging said hook means, and connecting means on the other end of the elongate member for connection to said securing means, the free end of the tongue being spaced from said connecting means a distance less than the distance said hook means is spaced from said securing means when the first and second body portions are adjacent one another and the elongate member is untensioned, the tongue of the elongate member being adapted to be brought overcenter with respect to the plane of the elongate member when the handle is pushed toward the body portion on which the hook means is mounted while the tongue is engaging said hook means thereby tensioning the elongate member and securing together the two body portions.

13. A latch assembly as set forth in claim 12 wherein said securing means is rotatable with respect to an axis perpendicular to the surface of the body portion on which the securing means is carried.

14. A latch assembly as set forth in claim 13 wherein the elongate member is pivotable with respect to an axis through said securing means parallel to the surface of the last said body portion.

15. A latch assembly as set forth in claim 14 wherein said securing means and said hook means are formed of synthetic resin material.

16. A latch assembly as set forth in claim 15 wherein said hook means is mounted on the cowl and said securing means is carried on the hood.

17. A latch as set forth in claim 14 wherein the handle and tongue have an internal relatively stiff and inflexible reinforcing core with a hardness substantially greater than that of the material from which said elongate elastomeric member is formed.

18. A latch assembly as set forth in claim 17 wherein the tongue of the elongate member has a rounded free end adapted to engage said hook means, the rounded free end of the tongue being formed by a protuding portion of the internal core, said hook means comprising a rounded hook portion complementary to the rounded free end of the tongue for removably receiving and holding the free end of the tongue.

19. A latch assembly as set forth in claim 18 wherein the distance between said rounded hook portion and the body portion on which said hook means is mounted is greater than the distance between the axis of the securing means on which the elongate member pivots and the body portion on which the securing means is carried.

* * * * *